US007475816B1

(12) United States Patent
Rochelo

(10) Patent No.: US 7,475,816 B1
(45) Date of Patent: Jan. 13, 2009

(54) PROTECTIVE CASE FOR A PLURALITY OF DIFFERENT SIZED MEMORY CARDS

(76) Inventor: Donald R. Rochelo, 323 Red Barn Rd., Dalton, MA (US) 01226

( * ) Notice: Subject to any disclaimer, the term of this patent is extended or adjusted under 35 U.S.C. 154(b) by 523 days.

(21) Appl. No.: 11/202,555

(22) Filed: Aug. 12, 2005

Related U.S. Application Data

(63) Continuation-in-part of application No. 10/860,471, filed on Jun. 3, 2004, now Pat. No. 7,306,159.

(60) Provisional application No. 60/601,544, filed on Aug. 13, 2004.

(51) Int. Cl.

| | |
|---|---|
| ***G06K 17/00*** | (2006.01) |
| ***G06K 19/00*** | (2006.01) |
| ***G06K 19/06*** | (2006.01) |
| ***G07C 13/00*** | (2006.01) |
| ***B65D 85/30*** | (2006.01) |
| ***B65D 85/57*** | (2006.01) |
| ***B65D 85/48*** | (2006.01) |

(52) U.S. Cl. ..... 235/386; 235/487; 235/492; 235/493; 206/308.1; 206/450

(58) Field of Classification Search ..... 206/307, 206/701, 722, 308.1, 387.1, 387.13, 450, 206/472, 491, 455, 316.1, 316.2, 706, 725; 235/386, 487, 492, 493

See application file for complete search history.

(56) References Cited

U.S. PATENT DOCUMENTS

| | | | | | |
|---|---|---|---|---|---|
| 2,261,806 | A | * | 11/1941 | Hills | 312/9.43 |
| 3,483,909 | A | * | 12/1969 | Mascolo et al. | 150/139 |
| 3,604,556 | A | * | 9/1971 | Schwartz | 206/387.1 |
| 3,640,379 | A | * | 2/1972 | Weingarden | 206/387.13 |
| 3,648,832 | A | * | 3/1972 | Kirshenbaum et al. | 206/37 |
| 4,117,931 | A | * | 10/1978 | Berkman | 206/387.14 |
| 4,285,557 | A | * | 8/1981 | Paladino et al. | 312/246 |
| 4,369,879 | A | * | 1/1983 | Egly et al. | 206/752 |
| 4,449,628 | A | * | 5/1984 | Egly et al. | 206/752 |
| 4,479,577 | A | * | 10/1984 | Eichner et al. | 206/753 |
| 4,538,730 | A | * | 9/1985 | Wu | 206/754 |
| 4,676,374 | A | * | 6/1987 | Wilkins | 206/308.3 |
| 4,703,943 | A | * | 11/1987 | Zelenko et al. | 206/472 |
| 4,892,189 | A | * | 1/1990 | Kunimune et al. | 206/232 |
| 5,036,973 | A | * | 8/1991 | Aida | 206/214 |
| 5,267,647 | A | * | 12/1993 | Stumpff et al. | 206/308.1 |
| 5,423,424 | A | * | 6/1995 | Young, III | 206/425 |
| 5,462,167 | A | * | 10/1995 | Polinski et al. | 206/455 |

(Continued)

*Primary Examiner*—Daniel Walsh
(74) *Attorney, Agent, or Firm*—Malcolm J. Chisholm, Jr.

(57) ABSTRACT

A protective case (10) for securing and protecting a plurality of different sized memory cards (31, 39, 54, 66, 77, 82, 90) includes a rigid exterior container (12) having a first shell (14) and a second shell (16). First and second resilient inserts (26, 28) are dimensioned to nest within the first and second shells (14, 16) and the inserts (26, 28) each define five memory card securing means (30, 42, 56, 72, 84) for securing differing sized memory cards (31, 39, 54, 66, 77, 82, 90) against unassisted removal from the case. Abutment edges (36, 48A, 48B) are defined to contact a peripheral edge of a memory card secured by the securing means. Extraction cavities (38A, 38B, 50A, 50B) are also defined on opposed edges of the secured cards for facilitating removal of the memory cards from the case.

11 Claims, 4 Drawing Sheets

U.S. PATENT DOCUMENTS 5,495,940 A * 3/1996 Taniyama ..... 206/308.1
5,588,528 A * 12/1996 Ozeki ..... 206/308.1
5,590,770 A * 1/1997 Yeh ..... 206/308.1
5,645,165 A * 7/1997 Taniyama ..... 206/308.1
5,697,498 A * 12/1997 Weisburn et al. ..... 206/308.1
5,725,098 A * 3/1998 Seifert et al. ..... 206/472
5,775,398 A * 7/1998 Siegel ..... 150/139
5,915,548 A * 6/1999 Sasaki ..... 206/307.1
5,933,328 A * 8/1999 Wallace et al. ..... 361/737
5,957,293 A * 9/1999 Pakeriasamy ..... 206/725
6,050,404 A * 4/2000 Lee ..... 206/308.1
6,097,605 A * 8/2000 Klatt et al. ..... 361/737
6,112,901 A * 9/2000 Noga et al. ..... 206/723
6,202,839 B1 * 3/2001 Petersen et al. ..... 206/308.1
6,227,372 B1 * 5/2001 Thomas et al. ..... 206/725
6,230,885 B1 * 5/2001 Rochelo et al. ..... 206/308.3
6,275,383 B1 * 8/2001 Bohm ..... 361/752
6,398,023 B1 * 6/2002 Williams ..... 206/308.1
6,409,013 B1 * 6/2002 Eskandry ..... 206/308.1
6,419,083 B1 * 7/2002 Huang ..... 206/308.1
6,443,306 B1 * 9/2002 Davies et al. ..... 206/473
6,520,329 B1 * 2/2003 Fuchs et al. ..... 206/449
6,738,259 B2 * 5/2004 Le et al. ..... 361/737
6,739,452 B2 * 5/2004 Rochelo ..... 206/454
6,871,682 B2 * 3/2005 Hogganvik ..... 150/149
6,877,603 B2 * 4/2005 Qualkenbush ..... 206/308.1
6,907,686 B2 * 6/2005 Symons ..... 40/700
6,976,624 B2 * 12/2005 Hsiao ..... 235/451
6,981,591 B2 * 1/2006 Logan ..... 206/451
7,017,809 B2 * 3/2006 Korber et al. ..... 235/440
7,066,386 B2 * 6/2006 Izumi ..... 235/381
7,100,765 B2 * 9/2006 Collins, IV ..... 206/308.1
7,102,516 B2 * 9/2006 Orman ..... 340/570
7,293,647 B2 * 11/2007 Wong et al. ..... 206/307.1
7,306,159 B1 * 12/2007 Rochelo ..... 235/492
2002/0038770 A1 * 4/2002 Liu ..... 206/308.1
2002/0074246 A1 * 6/2002 Tiscione et al. ..... 206/39.4
2002/0134694 A1 * 9/2002 Cherng ..... 206/308.1
2002/0185392 A1 * 12/2002 Hummell ..... 206/307
2002/0197098 A1 * 12/2002 Palmer ..... 402/79
2003/0038177 A1 * 2/2003 Morrow ..... 235/441
2003/0062275 A1 * 4/2003 Rochelo ..... 206/308.3
2003/0095386 A1 * 5/2003 Le et al. ..... 361/737
2003/0098257 A1 * 5/2003 Robertson ..... 206/538
2003/0150751 A1 * 8/2003 Chen ..... 206/307
2004/0016805 A1 * 1/2004 Li ..... 235/439
2004/0026278 A1 * 2/2004 Hitchings ..... 206/313
2004/0026487 A1 * 2/2004 Brook ..... 229/75
2004/0031709 A1 * 2/2004 Taw et al. ..... 206/312
2004/0065568 A1 * 4/2004 Kim ..... 206/308.1
2004/0079656 A1 * 4/2004 Hoogland ..... 206/307.1
2004/0089717 A1 * 5/2004 Harari et al. ..... 235/441
2004/0256257 A1 * 12/2004 Wang ..... 206/311
2005/0006258 A1 * 1/2005 O'Bryan ..... 206/232
2005/0051626 A1 * 3/2005 Hsiao ..... 235/441
2005/0145515 A1 * 7/2005 Gelardi et al. ..... 206/308.1
2005/0150796 A1 * 7/2005 Wong et al. ..... 206/320
2005/0252799 A1 * 11/2005 Wang ..... 206/311
2005/0252969 A1 * 11/2005 Wu ..... 235/441
2005/0258243 A1 * 11/2005 Hsieh ..... 235/441
2005/0269224 A1 * 12/2005 Giatsiakis ..... 206/308.1
2005/0279655 A1 * 12/2005 Chen ..... 206/307.1
2006/0065729 A1 * 3/2006 Miyairi ..... 235/441
2006/0071073 A1 * 4/2006 Wang ..... 235/441
2006/0102507 A1 * 5/2006 Dalrymple ..... 206/470
2006/0105634 A1 * 5/2006 Wu et al. ..... 439/630
2006/0144724 A1 * 7/2006 Ting et al. ..... 206/39
2006/0144751 A1 * 7/2006 Tsang ..... 206/707
2006/0151344 A1 * 7/2006 Mundy et al. ..... 206/308.1
2007/0012584 A1 * 1/2007 Begim ..... 206/312
2007/0157567 A1 * 7/2007 Curry ..... 53/443
2007/0163911 A1 * 7/2007 Gelardi ..... 206/473
2007/0163920 A1 * 7/2007 Sasaki ..... 206/725
2007/0278117 A1 * 12/2007 Kurata et al. ..... 206/308.1
2007/0284264 A1 * 12/2007 Davis ..... 206/39

* cited by examiner

PROTECTIVE CASE FOR A PLURALITY OF DIFFERENT SIZED MEMORY CARDS

CROSS REFERENCE TO RELATED APPLICATION

This Application claims the benefit of U.S. Provisional Patent Application Ser. Number 60/601,544 that was filed on Aug. 13, 2004, entitled "Protective Case for a Plurality of Different Sized Memory Cards". This application is also a continuation-in-part of Applicant's pending U.S. patent application Ser. No. 10/860,471 filed on Jun. 3, 2004 now U.S. Pat. No. 7,306,159 entitled "Protective Case For Six Different Sized Memory Cards".

TECHNICAL FIELD

The present invention relates to protective cases for portable memory cards, and in particular relates to a protective case that can secure a variety of different sized memory cards.

BACKGROUND ART

It is well known that memory devices for storage of data for modern electronic components, such as computers, cameras, entertainment systems, etc., are becoming increasingly smaller. For example, solid memory technology components currently and commonly referred to in the art as "memory cards", such as the well known "SONY" brand name "memory sticks" may be readily secured in containers as small as three inches in length and width and one-half inch in depth. Such small memory devices provide substantial conveniences in storing, backing-up and transferring data such as computer programs, visual images, audio data, etc. Because such memory devices are so small, however, they also give rise to significant risks related to transport of the devices. For example, dropping of the devices could damage them; exposure to moisture could likewise injure them; or contact of data transfer ports of the devices with foreign objects could also harm them.

It is known that some modern protective carriers exist for solid memory devices, such as a memory card protective carrier disclosed in U.S. Pat. No. 6,230,885 that issued on May 15, 2001 to the owners of all rights in the invention described herein, which patent is hereby incorporated herein by reference. The memory card protective carrier disclosed therein provides for a protective band to overlie data transfer ports of the memory card whenever the card is secured within the carrier. Similarly, U.S. Pat. No. 6,739,452 that issued on May 25, 2004, and that is also co-owned and also incorporated herein by reference, shows a rigid exterior shell housing soft resilient inserts within the shell to completely enclose a memory device and thereby protect it against damage from impact or fluid contamination. However, it is increasingly common that portable memory cards have varying external dimensions of width, length and thickness. Consequently, a user may utilize a protective container for one sized memory card, such as the "SONY" brand name "memory stick", and the container is unlikely to be able to protect and secure against unassisted extraction a memory card having exterior dimensions that vary from those of the "memory stick".

Additionally, the above referenced U.S. Pat. No. 6,739,452 and U.S. patent application Ser. No. 10/860,471 disclose protective cases wherein differing sized memory cards are secured by a various "flexible receiving posts", "pyramid posts", "inverse L-shaped posts", "crush ribs", "edge posts", "alignment ribs", "blocking ribs", etc. Such post-like structures provide for a minimal intimate contact between the securing structures and the memory cards thereby providing for ease of extraction of the cards from the various post-like securing means. Because of such minimal contact between the securing structures and edges of the memory cards, a user may simply apply their fingers or an extraction tool (e.g., a pencil or pen) adjacent an edge or opposed edges of the card that is not in contact with a securing structure to readily remove the card from the securing means.

However, to more firmly secure a memory card within a protective case, it is necessary that securing structures contact a greater proportion of an edge or edges of the memory cards to thereby apply a greater friction load between the securing structures and the memory card. Such enhanced friction, though, will necessarily make extraction of the memory cards more difficult, and will raise a risk of damage of the cards upon extraction.

Accordingly, there is a need for a protective case that adequately protects memory cards having varying exterior dimensions and that provides for enhanced retention of the cards within the case, and that also facilitates extraction of the cards from the case while minimizing risk of damage of the cards upon extraction of the cards from the case.

SUMMARY OF THE INVENTION

The invention is a protective case for securing and protecting a plurality of different sized memory cards having exterior dimensions of length, width and thickness that are distinct from each other. The case includes a rigid exterior container having a first shell and a second shell and a latch and hinge for securing the first shell to the second shell to define a containment chamber between the first and second shells. A first resilient insert is dimensioned to nest within the first shell and a second resilient insert is dimensioned to nest within the second shell. The first and second resilient inserts each define a first sized memory card securing means for securing a first sized memory card against unassisted removal from the case, a second sized memory card securing means for securing a second sized memory card against unassisted removal from the case, a third sized memory card securing means for securing a third sized memory card against unassisted removal from the case, a fourth sized memory card securing means for securing a fourth sized memory card against unassisted removal from the case, and a fifth sized memory card securing means for securing a fifth sized memory card against unassisted removal from the case.

Five border alignments defined by the five memory card securing means each define at least one abutment edge dimensioned to abut in intimate contact at least one-quarter of a length of a peripheral edge of a memory card secured by the securing means. Additionally, the five border alignments defined by the five memory card securing means each define extraction cavities on opposed edges of the border alignments for facilitating extraction of the memory cards from the memory card securing means.

By providing the abutment edges in each of the five border alignments, the protective case of the present invention significantly enhances a secure retention of the memory cards within the inserts. By also providing the extraction cavities on the opposed edges of the border alignments, the protective case facilitates ready extraction of the memory cards from the inserts while minimizing any risk of damage of the cards during extraction and storage within the protective case.

Additionally, whenever the latch secures the first and second shells of the protective case in a closed position, the border alignments defined by the five memory card securing means of the first resilient insert overlie the five border alignments defined by the five memory card securing means of the second resilient insert. This provides for an extraordinarily efficient protective case wherein at least two of any identical sized memory cards and one or more additional differing sized cards can be simultaneously secured and protected against damage from impacts from dropping the container, and from contaminants, such as moisture, liquid spills, etc.

Accordingly, it is a general purpose of the present invention to provide a protective case for a plurality of different sized memory cards that overcomes deficiencies of the prior art.

It is a more specific purpose to provide a protective case for a plurality of different sized memory cards that enhances retention of memory cards within the case while facilitating extraction of the memory cards from the case with a minimal risk of damage to the cards by extraction of the cards from the resilient inserts.

These and other purposes and advantages of the present protective case for a plurality of different sized memory cards will become more readily apparent when the following description is read in conjunction with the accompanying drawings.

DESCRIPTION OF THE PREFERRED EMBODIMENTS

Figure 1:
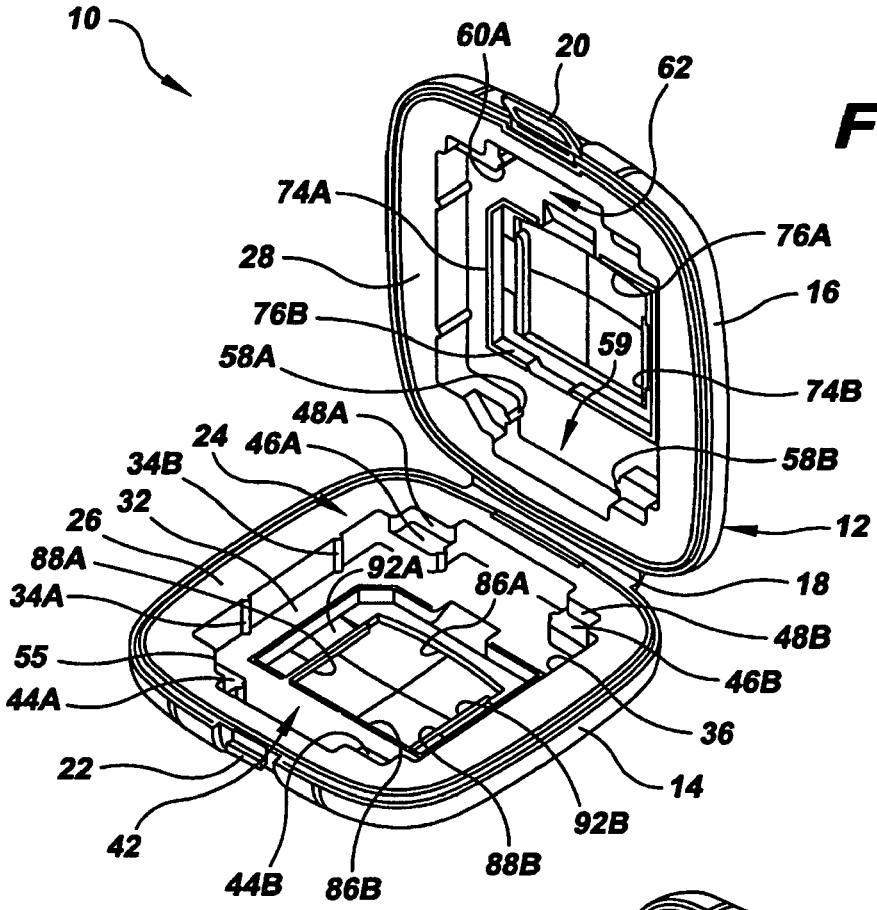
FIG. 1 is a perspective view of a protective case for a plurality of different sized memory cards constructed in accordance with the present invention showing a rigid exterior container having a first shell hinged to a second shell in an open position.

Referring to the drawings in detail, a protective case for a plurality of different sized memory cards is shown in FIG. 1, and is generally designated by the reference numeral 10. The case 10 includes a rigid exterior container 12 having a first shell 14 and a second shell 16. The container 12 includes latch means for securing the first shell 14 to the second shell 16 such as a hinge 18 between the shells 14, 16, and a latch 20 on the second shell 16 that engages a latch-block 22 on the first shell 14 to close the rigid container 12 and thereby define a containment chamber 24 between the shells 14, 16. The securing means may be any other structure known in the art that is capable of securing two halves of a rigid container.

A first resilient insert 26 is dimensioned to nest within the first shell 14, and second resilient insert 28 is dimensioned to nest within the second shell 16. The first and second inserts 26, 28 may be secured within the respective first and second shells 14, 18 by one or more "flared tongues" (not shown) extending from the inserts 26, 28 to pass through "tongue slots" (not shown) defined within the shells 14, 16, as described in the aforesaid, co-owned U.S. Pat. No. 6,739,452 with respect to reference numerals 34 and 36 described in that patent, or the inserts 26, 28 may be secured by any means known in the art.

The first and second resilient inserts 26, 28 are manufactured of any resilient deformable material that is more resilient than the rigid container 12, such as soft, elastic or rubbery material known in the art to cushion memory cards devices against a shock of accidental impact, and to provide enhanced friction through the "flared tongues" described in the aforesaid U.S. Pat. No. 6,739,452. As described therein, the "flared tongues" extend beyond an exterior surface of the first and second shells 14, 16 so that the "flared tongues" contact a support surface holding the case 10 to provide friction against accidental sliding off of the support surface, and to minimize a risk of slipping out of a hand of a user. A preferred material for the resilient inserts 26, 28 is a thermoplastic rubber, such as "SANTOPRENE" brand name thermoplastic rubber manufactured by the Advanced Elastomer Systems, Co. of Akron Ohio, U.S.A.

The first resilient insert 26 and second resilient insert 28 each define first sized memory card securing means 30 for securing a first sized memory card 31 (shown in FIG. 2) within the inserts 26, 28 against unassisted removal from the protective case 10. (In FIG. 2, the first sized memory card 31 is shown with a trademark "EFILM" well known in the art and available from the "Compact Flash" company.) By the phrase "against unassisted removal from the case", it is meant that the memory cards referred to herein may not fall or tumble out of the case by the force of gravity alone, and instead require a user to apply a common removal force known in the art to remove the cards from the case, thereby protecting the cards against accidental damage from falling out of the case 10, such as upon opening of the case 10. For purposes of efficiency and clarity of reference numerals and lead lines in the accompanying drawings, the following descriptions of five different memory card securing means will be with respect to only one of the two inserts 26, 28. It is to be understood, however, that each of the inserts 26, 28 include virtually identical memory card securing means.

Figure 2:
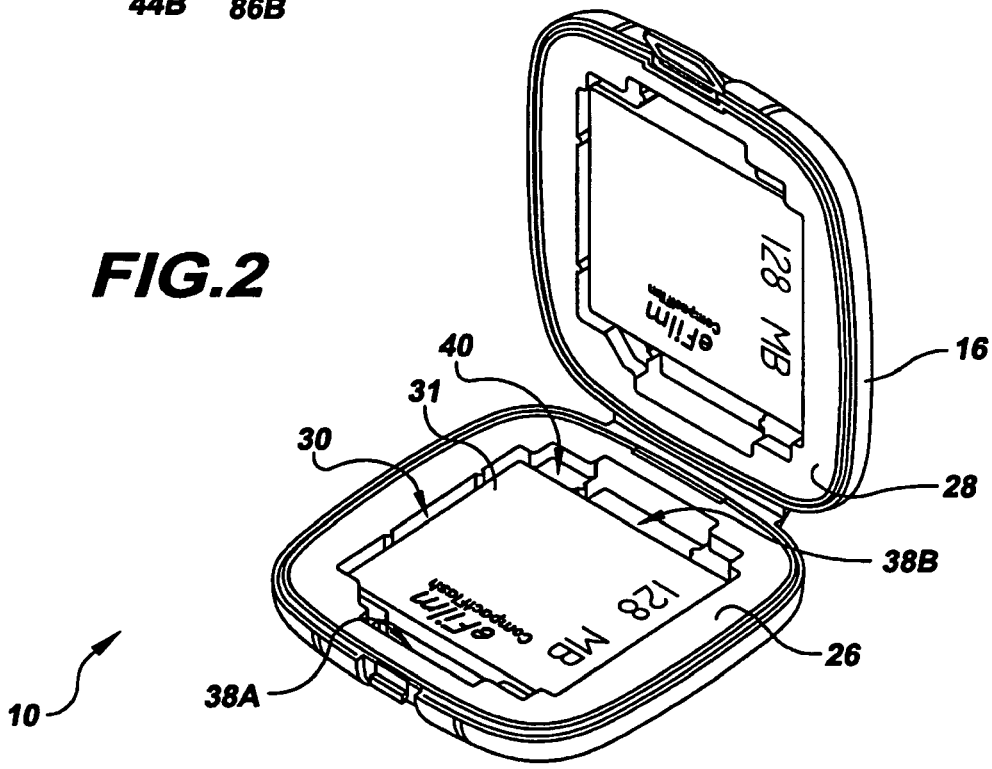
FIG. 2 is a perspective view of the protective case of FIG. 1, showing a first sized memory card secured within a first sized memory card securing means within first and second resilient inserts of the case.
Figure 3:
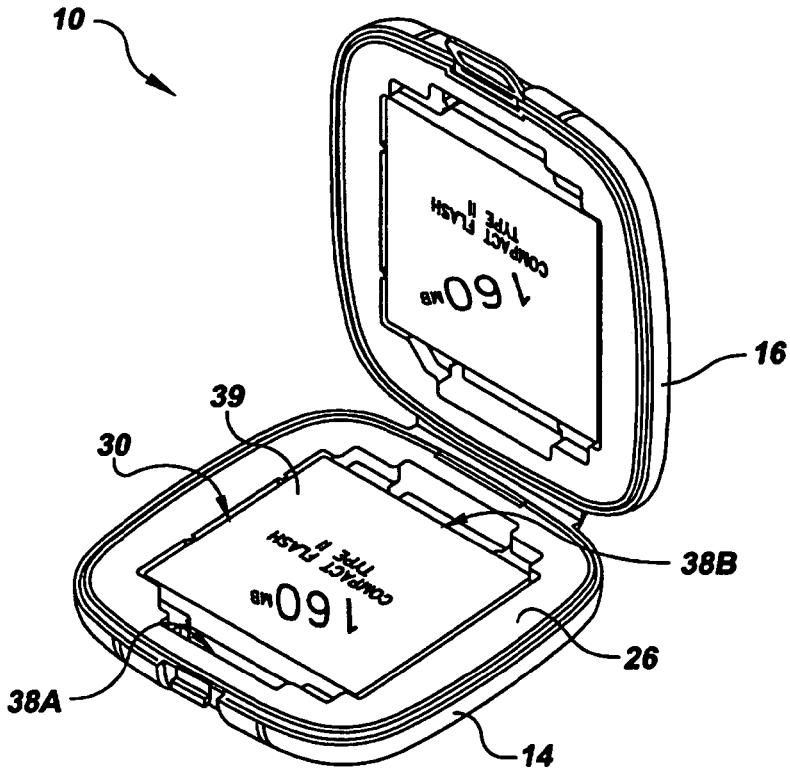
FIG. 3 is a perspective view of the protective case of FIG. 1, showing a first variation of the first sized memory card secured within the first sized memory card securing means within the first and second resilient inserts of the case.

As best seen in FIGS. 1-3 with respect to the first resilient insert 14, the first sized memory card securing means 30 includes a first shelf 32, and a pair of crush ribs 34A, 34B and an opposed first abutment edge 36. The fist sized memory card securing means 30 also includes opposed first pair of extraction cavities 38A, 38B (shown best in FIGS. 2 and 3) defined between the crush ribs 34A, 34B and the abutment edge 36 to facilitate extraction of the first sized memory card 40. The crush ribs 34A, 34B, first abutment edge 36 and first pair of extraction cavities 38A, 38B cooperate to define a first border alignment 40 surrounding the first sized memory card 31. FIG. 3 shows a first variation 39 of the first sized memory card 31 secured within the first border alignment 40 by the first sized memory card securing means. The first variation 39 of the first sized memory card is essentially thicker than the first sized memory card 31, but has the same length dimension extending between the crush ribs 34A, 34B and the first abutment edge 36. (The first variation 39 of the first sized memory card is shown in FIG. 3 with a trademark "COMPACT FLASH TYPE II".) Such variations of sizes of memory cards are well-known in the art.

Figure 4:
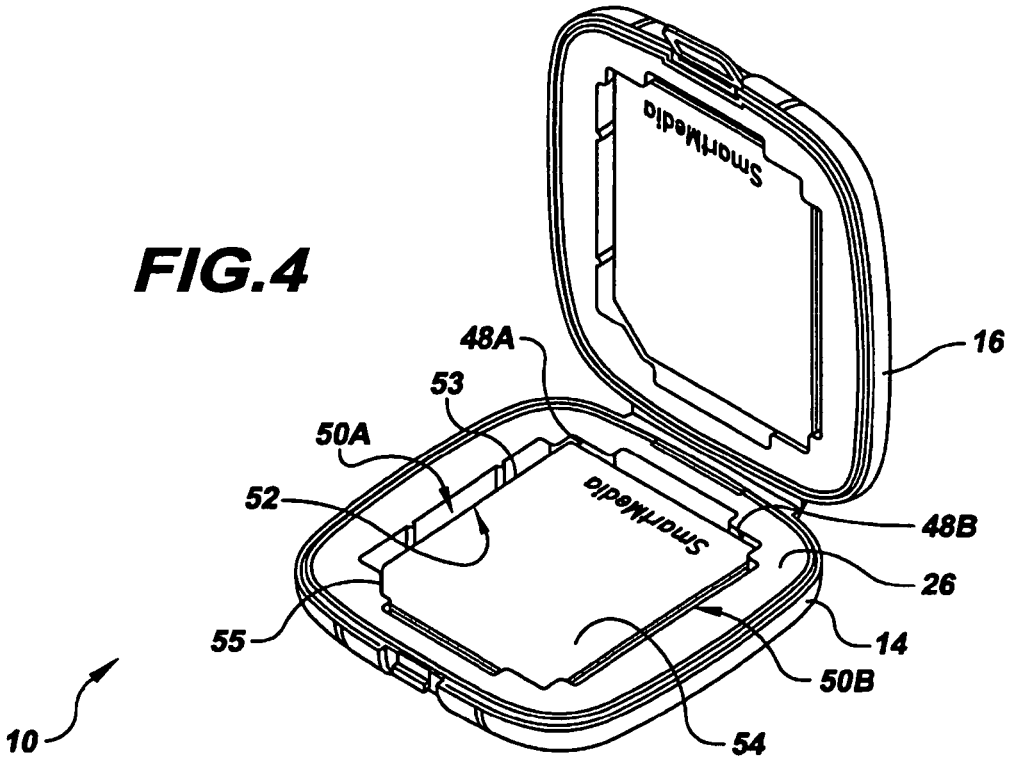
FIG. 4 is a perspective view of the protective case of FIG. 1, showing a second sized memory card secured within a second sized memory card securing means within the first and second resilient inserts of the case.

A second sized memory card securing means 42 is shown best in FIGS. 1 and 4, and includes a first shoulder pair 44A, 44B and an opposed second shoulder pair 46A, 46B adjacent a split abutment edge 48A, 48B. A second pair of extraction cavities 50A, 50B is defined by a second border alignment 52 extending between the first and second shoulder pairs 44A, 44B, 46A, 46B to facilitate extraction of a second sized memory card 54 from the second sized memory card securing means 42. The split abutment edges 48A, 48B are dimensioned to extend along the second border alignment 52 a distance that totals at least one-quarter of a length of a peripheral edge 53 adjacent the split abutment edges 48A, 48B of the second sized memory card 54. (In FIG. 4, the second sized memory card 54 is shown with a well known trademark "SMART MEDIA".) The second border alignment 52 may also include an angled guide corner 55 dimensioned to correspond to an angled corner of the second sized memory card 54 as seen best in FIG. 4.

Figure 5:
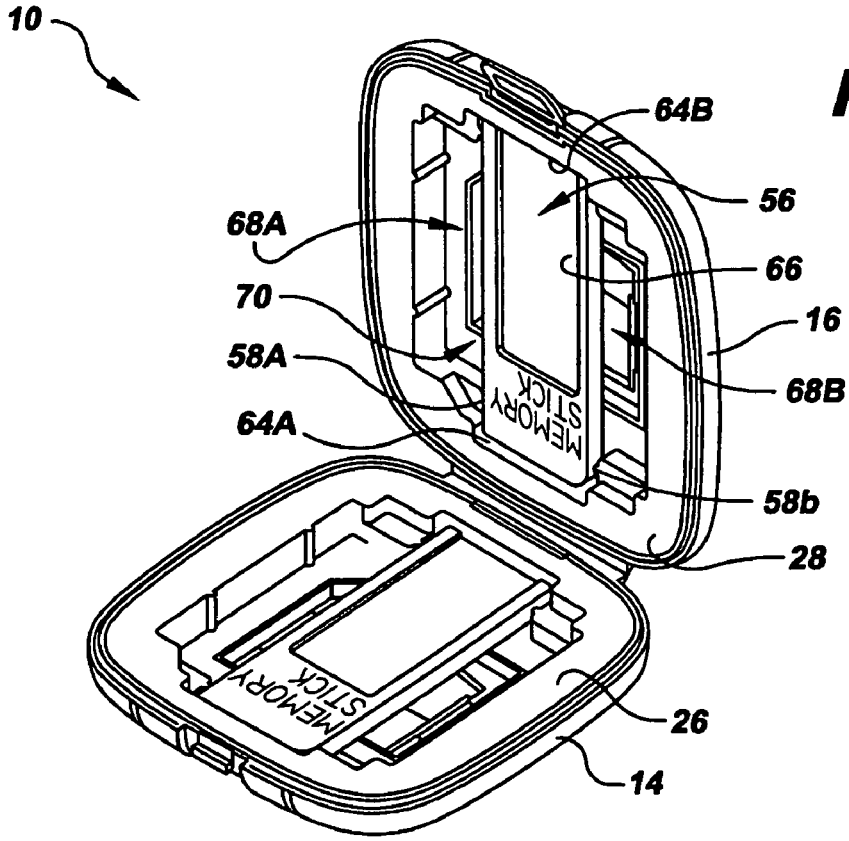
FIG. 5 is a perspective view of the protective case of FIG. 1, showing a third sized memory card secured within a third sized memory card securing means within first and second resilient inserts of the case.

A third sized memory card securing means 56 is best seen in FIGS. 1 and 5 with respect to the second shell 16, and includes a first pair of facing crush ribs 58A, 58B that face each other from opposed sides of a first securing slot 59, and a second pair of facing crush ribs 60A 60B (60B is not seen in FIG. 1 or 5) that face each other from opposed sides of a second securing slot 62. The first and second securing slots 59, 62 are defined adjacent to and above the first shelf 32. The third sized memory card securing means 56 also includes opposed third abutment edges 64A, 64B that extend across the opposed first and second securing slots 59, 62 that contact a third sized memory card 66. A third pair of extraction cavities 68A, 68B extends between the first and second securing slots 59, 62 to form with the slots 59, 62 a third border alignment 70 for securing a third sized memory card 66 within the third sized card securing means 56 and for facilitating extraction of the card 66 therefrom. (The third sized memory card 66 is shown in FIG. 5 with the well known trademark "MEMORY STICK" of the Sony Company.)

Figure 6:
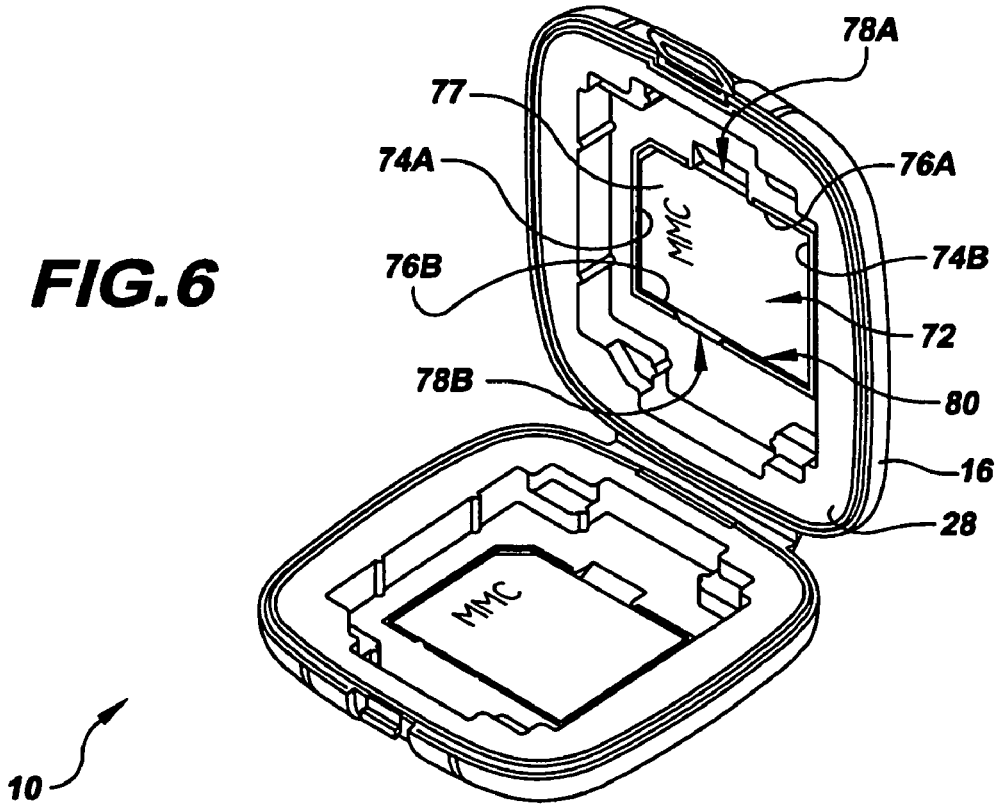
FIG. 6 is a perspective view of the protective case of FIG. 1, showing a fourth sized memory card secured within a fourth sized memory card securing means within first and second resilient inserts of the case.
Figure 7:
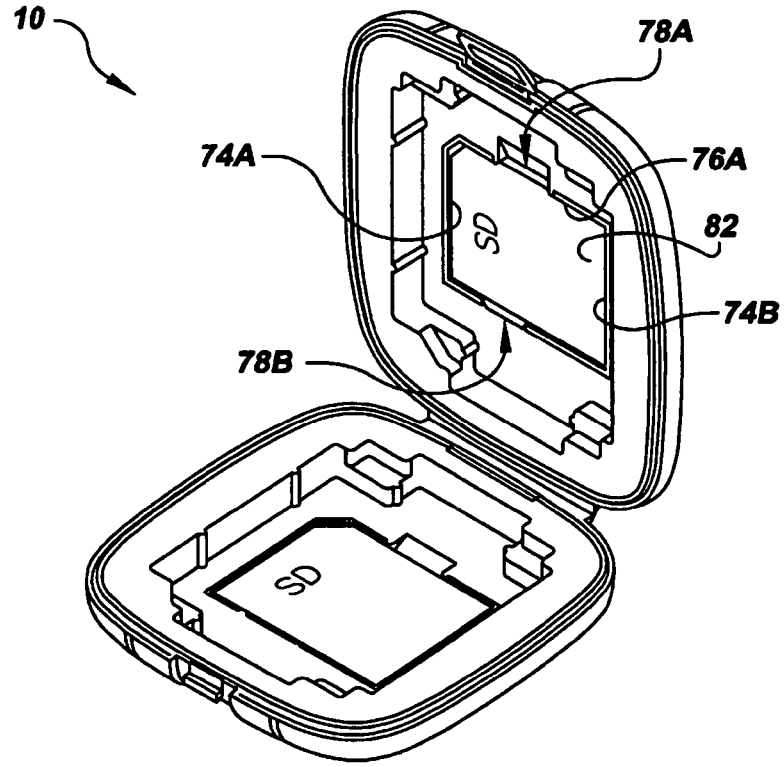
FIG. 7 is a perspective view of the protective case of FIG. 1, showing a first variation of the fourth sized memory card secured within the fourth sized memory card securing means within first and second resilient inserts of the case.

A fourth sized memory card securing means 72 is shown best in FIGS. 1 and 6 with respect to the second shell 16, and includes a first pair of opposed abutment edges 74A, 74B. Extending between the first pair 74A, 74B is a second pair of opposed abutment edges 76A, 76B. The pairs of abutment edges are dimensioned to contact and secure a fourth sized memory card 77 between the four abutment edges. A fourth pair of extraction cavities 78A, 78B (shown in FIG. 6) is also defined along the second pair of opposed abutment edges 76A, 76B to form with the four abutment edges a fourth border alignment 80 for securing the fourth sized memory card 77 within the fourth sized card securing means 72 and for facilitating extraction of the memory card 77 from the case 10. (In FIG. 6, the fourth sized memory card 77 is shown with the well known trademark "MMC".) FIG. 7 shows a first variation of the fourth sized memory card 82 secured by the fourth sized memory card securing means 72 within the fourth border alignment 80. As discussed above, the first variation of the fourth sized memory card exhibits common peripheral dimensions, but varies in inconsequential dimensions, such as thickness, as is common in the art. (In FIG. 7, the first variation of the fourth sized memory card 82 is shown with the well known trademark "SD".)

Figure 8:
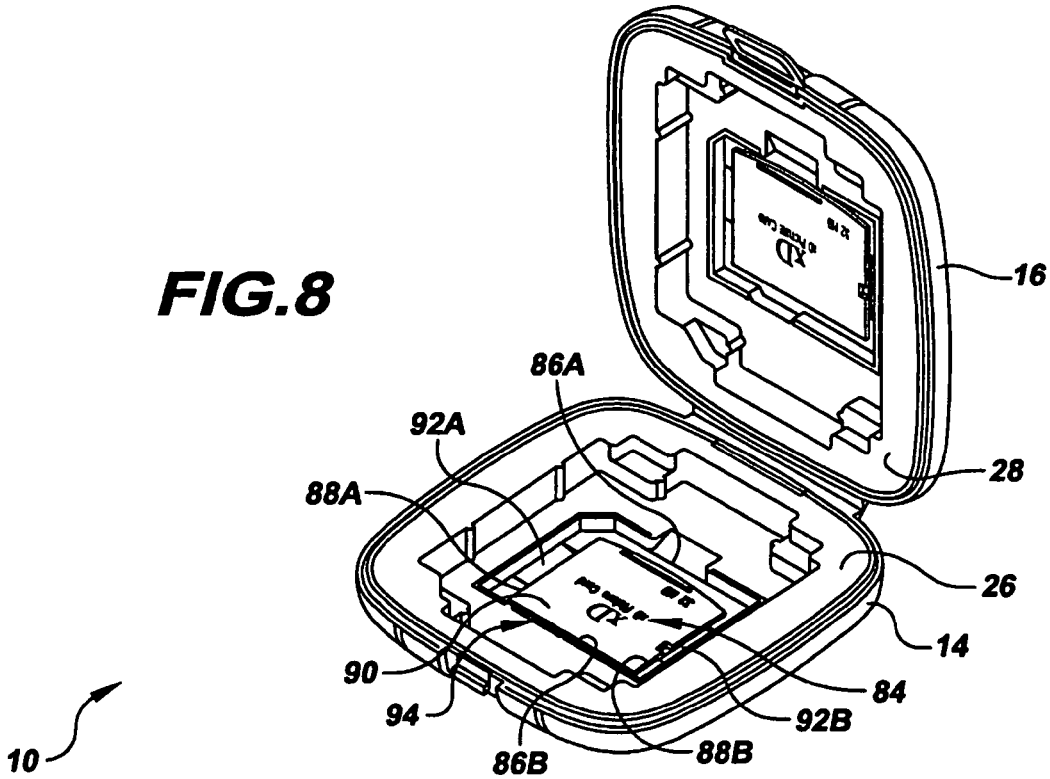
FIG. 8 is a perspective view of the protective case of FIG. 1, showing a fifth sized memory card secured within a fifth sized memory card securing means within first and second resilient inserts of the case.

A fifth sized memory card securing means 84 is shown best in FIGS. 1 and 8 with respect to the first shell 14 and first resilient insert 26, and includes a third pair of opposed half-depth abutment edges 86A, 86B. Extending between the third pair of abutment edges is a fourth pair of opposed abutment edges 88A, 88B. The third and fourth pairs of abutment edges are dimensioned to abut and thereby secure by friction a fifth sized memory card 90. (In FIG. 8, the fifth sized memory card 90 is shown with a trademark "XD PICTURE CARD" well known in the art.) A fifth pair of extraction cavities 92A, 92B (shown in FIGS. 1 and 8) is also defined along the fourth pair of opposed abutment edges 88A, 88B to form with the four abutment edges a fifth border alignment 94 for securing the fifth sized memory card 90 within the fifth sized card securing means 84 and for facilitating extraction of the fifth sized memory card 90 from the case 10.

As is apparent, the first 38A, 38B, second 50A, 50B, third 68A, 68B, fourth 78A, 78B, and fifth 92A, 92B pairs of extraction cavities provide for enhanced ease of extraction of the described varying sized memory cards by providing access from opposed edges of the cards, thereby minimizing risk of damage to the cards upon extraction from the protective case 10. As can also be readily seen, whenever the latch means secures the protective case 10 in a closed position, the five border alignments 40, 52, 70, 80, 94 of each of the first and second resilient inserts 14, 16 overlie each other to provide for an extremely compact storage container. By the phrase "overlie each other" it is meant that a vertical axis passing through and perpendicular to a smallest border alignment, such as the fifth border alignment 94, also passes through all the other border alignments. By this efficient design in structuring the five securing means 30, 42, 56, 72 and 84 to define five border alignments overlying each other, the protective case 10 for securing and protecting a plurality of different sized memory cards 31, 40, 54, 66, 77, 82, 90 is readily distinguished from containers that define bulky "side-by-side" or "egg carton" types of securing apparatus that are expensive to manufacture and inefficient to use. By the described structure and arrangement of the protective case 10, at least two of any identical sized memory cards and one or more additional differing sized cards can be simultaneously secured and protected against damage from impacts from dropping the container, 10 and from contaminants, such as moisture, liquid spills, etc.

Additionally, by the first and second resilient inserts 14, 16 being identical to each other, the protective case 10 may be efficiently manufactured with a minimal requirement of plastic molds. Moreover, the combination of the described abutment edges and extraction cavities provides greater durability of the securing means than known protective containers utilizing "post-like" structures known in the art, while also providing enhanced ease of extraction of the cards from the case 10.

While the present invention has been disclosed with respect to the described and illustrated embodiments, it is to be understood that the invention is not to be limited to those embodiments. For example, while the protective case 10 is described with the first and second resilient inserts 26, 28 within the first and second rigid shells 14, 16, for certain purposes it may be more efficient to use only one of the resilient inserts 26, 28 secured within one of the rigid shells 14, 16, while the other shell may be used for other purposes, such as enhanced sealing, enhanced cushioning, etc. Accordingly, reference should be made primarily to the following claims rather than the foregoing description to determine the scope of the invention.

What is claimed is:

1. A protective case (10) for securing and protecting a plurality of different sized memory cards (31, 39, 54, 66, 77, 82, 90) having exterior dimensions of length, width and thickness distinct from each other, the case comprising:

a. a rigid exterior container (12) having a first shell (14) and a second shell (16) including latch means for securing the first shell (14) to the second shell (16) to define a containment chamber (24) between the first and second shells (14, 16);

b. at least one resilient insert (26) dimensioned to nest within one of the first or second shells (14, 16);

c. wherein the at least one resilient insert (26) defines a first of the plurality of different sized memory card securing means (30) for securing a first sized memory card (31) against unassisted removal from the case (10), a second of the plurality of different sized memory card securing means (42) for securing a second sized memory card (54) against unassisted removal from the case (10), a third of the plurality of different sized memory card securing means (56) for securing a third sized memory card (66) against unassisted removal from the case (10), a fourth of the plurality of different sized memory card securing means (72) for securing a fourth sized memory card (77) against unassisted removal from the case (10), and a fifth of the plurality of different sized memory card securing (84) means for securing a fifth sized memory card (90) against unassisted removal from the case (10);

d. wherein five border alignments (40, 52, 70, 80, 94) defined by the five memory card securing means (30, 42, 56, 72, 84) each define at least one abutment edge (36, 48A, 48B, 64A, 64B, 74A, 74B, 86A, 86B) dimensioned to abut in intimate contact at least one-quarter of a length of a peripheral edge of a memory card (31, 39, 54, 66, 77, 82, 90) secured by the securing means to secure the memory card against unassisted removal from the securing means;

e. wherein the five border alignments (40, 52, 70, 80, 94) defined by the five memory card securing means (30, 42, 56, 72, 84) each define extraction cavities (38A, 38B, 50A, 50B, 68A, 68B, 78A, 78B, 92A, 92B) on opposed edges of the border alignments for facilitating removal of the memory cards from the memory card securing means; and, f. wherein the first of the plurality of different sized memory card securing means (30) includes a first shelf (32), a first pair of crush ribs (34A, 34B) above and adjacent the first shelf (32), a first abutment edge (36) above and adjacent the first shelf (32) opposed to the first crush ribs (34A, 34B) and configured so that the first pair of crush ribs (34A, 34B) and the first abutment edge (36) contact opposing sides of the first sized memory card (31) whenever the first sized memory card (31) sits on the first shelf (32) in the first memory card securing means (30), and the first pair of extraction cavities (38A, 38B) between the first pair of crush ribs and first abutment edge, being defined within the insert (26) to form the first border alignment (40), and wherein the first of the plurality of different sized memory card securing means (30) overlies the second, third, fourth and fifth memory card securing means (42, 56, 72, 84).

2. The protective case (10) for securing and protecting a plurality of different sized memory cards (31, 39, 54, 66, 77, 82, 90) of claim 1, wherein the second of the plurality of different sized memory card securing means (42) includes a first shoulder pair (44A, 44B) and an opposed second shoulder pair (46A, 46B) defined within the insert (26) upon a first shelf (32), and split abutment edges (48A, 48B) upon one of the first or second shoulder pairs (44A, 44B, 46A, 46B) and a second pair of extraction cavities (50A, 50B) extending between the first and second shoulder pairs (44A, 44B, 46A, 46B) to form the second border alignment (52).

3. The protective case (10) for securing and protecting a plurality of different sized memory cards (31, 39, 54, 66, 77, 82, 90) of claim 1, wherein the third of the plurality of different sized memory card securing means (56) includes a first pair of facing crush ribs (58A, 58B) that face each other from opposed sides of a first securing slot (59), a second pair of facing crush ribs (60A, 60B) that face each other from opposed sides of a second securing slot (62) defined within the insert (26) above a first shelf (32), the third abutment edges (64A, 64B) extending across the opposed first and second securing slots (59, 62), and a third pair of extraction cavities (68A, 68B) extending between the first and second securing slots (59, 62) to form the third border alignment (70).

4. The protective case (10) for securing and protecting a plurality of different sized memory cards (31, 39, 54, 66, 77, 82, 90) of claim 1, wherein the fourth of the plurality of different sized memory card securing means (72) includes a first pair of opposed abutment edges (74A, 74B) defined adjacent a first shelf (32) of the insert (26) and a second pair of opposed abutment edges (76A, 76B) extending between the first pair (74A, 74B), and a fourth pair of extraction cavities (78A, 78B) defined along one of the first or second pair of opposed abutment edges (74A, 74B, 76A, 76B) to form the fourth border alignment (80).

5. The protective case (10) for securing and protecting a plurality of different sized memory cards (31, 39, 54, 66, 77, 82, 90) of claim 1, wherein the fifth of the plurality of different sized memory card securing means (84) includes a third pair of opposed abutment edges (86A, 86B), a fourth pair of opposed abutment edges (88A, 88B) extending between the third pair of opposed abutment edges (86A, 86B) defined adjacent a first shelf (32) of the insert (26), and a fifth pair of extraction cavities (92A, 92B) defined along one of the third or fourth pair of opposed abutment edges (86A, 86B, 88A, 88B) to form the fifth border alignment (94).

6. A protective case (10) for securing and protecting a plurality of different sized memory cards (31, 39, 54, 66, 77, 82, 90) having exterior dimensions of length, width and thickness distinct from each other, the case comprising:

a. a rigid exterior container (12) having a first shell (14) and a second shell (16) including latch means for securing the first shell (14) to the second shell (16) to define a containment chamber (24) between the first and second shells (14, 16);

b. a first resilient insert (26) dimensioned to nest within the first shell (14) and a second resilient insert (28) dimensioned to nest within the second shell (16);

c. wherein the first and second resilient inserts (26, 28) each define a first of the plurality of different sized memory card securing means (30) for securing a first sized memory card (31) against unassisted removal from the case (10), a second of the plurality of different sized memory card securing means (42) for securing a second sized memory card (54) against unassisted removal from the case (10), a third of the plurality of different sized memory card securing means (56) for securing a third sized memory card (66) against unassisted removal from the case (10), a fourth of the plurality of different sized memory card securing means (72) for securing a fourth sized memory card (77) against unassisted removal from the case (10), and a fifth of the plurality of different sized memory card securing (84) means for securing a fifth sized memory card (90) against unassisted removal from the case (10);

d. wherein five border alignments (40, 52, 70, 80, 94) defined by the five memory card securing means (30, 42, 56, 72, 84) each define at least one abutment edge (36, 48A, 48B, 64A, 64B, 74A, 74B, 86A, 86B) dimensioned to abut in intimate contact at least one-quarter of a length of a peripheral edge of a memory card (31, 39, 54, 66, 77, 82, 90) secured by the securing means to secure the memory card against unassisted removal from the securing means;

e. wherein the five border alignments (40, 52, 70, 80, 94) defined by the five memory card securing means (30, 42, 56, 72, 84) each define extraction cavities (38A, 38B, 50A, SOB, 68A, 68B, 78A, 78B, 92A, 92B) on opposed edges of the border alignments for facilitating removal of the memory cards from the memory card securing means; and f. wherein the first of the plurality of different sized memory card securing means (30) includes a first shelf (32), a first pair of crush ribs (34A, 34B) above and adjacent the first shelf (32), a first abutment edge (36) above and adjacent the first shelf (32) opposed to the first crush ribs (34A, 34B) and configured so that the first pair of crush ribs (34A, 34B) and the first abutment edge (36) contact opposing sides of the first sized memory card (31) whenever the first sized memory card (31) sits on the first shelf (32) in the first memory card securing means (30), and the first pair of extraction cavities (38A, 38B) between the first pair of crush ribs and first abutment edge, being defined within the insert (26) to form the first border alignment (40), and wherein the first of the plurality of different sized memory card securing means (30) overlies the second, third, fourth and fifth memory card securing means (42, 56, 72, 84).

7. The protective case (10) for securing and protecting a plurality of different sized memory cards (31, 39, 54, 66, 77, 82, 90) of claim 6, wherein the border alignments (40, 52, 70, 80, 94) defined by the five memory card securing means (30, 42, 56, 72, 84) of the first resilient insert (26) overlie the five border alignments 40, 52, 70, 80, 94) defined by the five memory card securing means (30, 42, 56, 72, 84) of the second resilient insert (28) whenever the latch means secures the first shell (14) to the second shell (16).

8. The protective case (10) for securing and protecting a plurality of different sized memory cards (31, 39, 54, 66, 77, 82, 90) of claim 7, wherein the second of the plurality of different sized memory card securing means (42) includes a first shoulder pair (44A, 44B) and an opposed second shoulder pair (46A, 46B) defined within the inserts (26, 28) upon the first shelf (32), and split abutment edges (48A, 48B) upon one of the first or second shoulder pairs (44A, 44B, 46A, 46B), and a second pair of extraction cavities (50A, 50B) extending between the first and second shoulder pairs (44A, 44B, 46A, 46B), to form the second border alignment (52).

9. The protective case (10) for securing and protecting a plurality of different sized memory cards (31, 39, 54, 66, 77, 82, 90) of claim 8, wherein the third of the plurality of different sized memory card securing means (56) includes a first pair of facing crush ribs (58A, 58B) that face each other from opposed sides of a first securing slot (59), a second pair of facing crush ribs (60A, 60B) that face each other from opposed sides of a second securing slot (62) defined within the inserts (26, 28) above the first shelf (32), third abutment edges (64A, 64B) extending across the opposed first and second securing slots (59, 62), and a third pair of extraction cavities (68A, 68B) extending between the first and second securing slots (59, 62) to form the third border alignment (70).

10. The protective case (10) for securing and protecting a plurality of different sized memory cards (31, 39, 54, 66, 77, 82, 90) of claim 9, wherein the fourth of the plurality of different sized memory card securing means (72) includes a first pair of opposed abutment edges (74A, 74B) defined adjacent the first shelf (32) of the inserts (26, 28) and a second pair of opposed abutment edges (76A, 76B) extending between the first pair of opposed abutment edges (74A, 74B), and a fourth pair of extraction cavities (78A, 78B) defined along one of the first or second pair of opposed abutment edges (74A, 74B, 76A, 76B) to form the fourth border alignment (80).

11. The protective case (10) for securing and protecting a plurality of different sized memory cards (31, 39, 54, 66, 77, 82, 90) of claim 10, wherein the fifth of the plurality of different sized memory card securing means (84) includes a third pair of opposed abutment edges (86A, 86B), a fourth pair of opposed abutment edges (88A, 88B) extending between the third pair of opposed abutment edges (86A, 86B) defined adjacent the first shelf (32) of the inserts (26, 28), and a fifth pair of extraction cavities (92A, 92B) defined along one of the third or fourth pair of opposed abutment edges (86A, 86B, 88A, 88B) to form the fifth border alignment (94).

* * * * *